US010082751B2

(12) United States Patent
Seto et al.

(10) Patent No.: US 10,082,751 B2
(45) Date of Patent: Sep. 25, 2018

(54) FIXING DEVICE AND IMAGE FORMING APPARATUS

(71) Applicants: Takashi Seto, Kanagawa (JP); Kenji Ishii, Kanagawa (JP); Hiroshi Yoshinaga, Chiba (JP); Takayuki Seki, Kanagawa (JP); Ippei Fujimoto, Kanagawa (JP); Hiroyuki Shimada, Tokyo (JP); Kazunari Sawada, Shizuoka (JP); Ryohei Matsuda, Kanagawa (JP)

(72) Inventors: Takashi Seto, Kanagawa (JP); Kenji Ishii, Kanagawa (JP); Hiroshi Yoshinaga, Chiba (JP); Takayuki Seki, Kanagawa (JP); Ippei Fujimoto, Kanagawa (JP); Hiroyuki Shimada, Tokyo (JP); Kazunari Sawada, Shizuoka (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/804,459

(22) Filed: Nov. 6, 2017

(65) Prior Publication Data

US 2018/0157198 A1 Jun. 7, 2018

(30) Foreign Application Priority Data

Dec. 6, 2016 (JP) ..... 2016-236971

(51) Int. Cl.
*G03G 15/20* (2006.01)

(52) U.S. Cl.
CPC ..... *G03G 15/2025* (2013.01); *G03G 15/2053* (2013.01); *G03G 15/2085* (2013.01)

(58) Field of Classification Search
CPC ..... G03G 15/2025; G03G 15/2053; G03G 15/2075; G03G 15/2085; G03G 2215/2093
See application file for complete search history.

(56) References Cited

U.S. PATENT DOCUMENTS 4,592,651 A 6/1986 Oikawa et al.
4,640,611 A 2/1987 Ohdake et al.
(Continued)

FOREIGN PATENT DOCUMENTS

JP 2010-032631 2/2010
JP 2011-033654 2/2011
JP 2016-145961 8/2016

OTHER PUBLICATIONS

U.S. Appl. No. 15/604,294, filed May 24, 2017 Takayuki Seki, et al.
(Continued)

*Primary Examiner* — Sophia S Chen
(74) *Attorney, Agent, or Firm* — Oblon, McClelland, Maier & Neustadt, L.L.P.

(57) ABSTRACT

A fixing device includes a belt, a pressure rotator disposed opposite the belt, and a nip formation unit that forms a fixing nip between the belt and the pressure rotator. The nip formation unit includes a guide face disposed upstream from the fixing nip in a rotation direction of the belt and contoured to separate from the pressure rotator in a direction opposite the rotation direction of the belt. The guide face is adhered with a lubricant moved from an inner circumferential surface of the belt. The belt rotates in the rotation direction when an outer circumferential surface of the belt has a temperature lower than a fixing temperature at which the belt fixes a toner image on a recording medium. The belt rotating in the rotation direction brings the lubricant adhered to the guide face into contact with the belt.

15 Claims, 6 Drawing Sheets

(56) References Cited

U.S. PATENT DOCUMENTS

| | | | | |
|---|---|---|---|---|
| 5,060,012 | A | 10/1991 | Seto et al. | |
| 5,263,698 | A | 11/1993 | Higuchi et al. | |
| 5,521,679 | A | 5/1996 | Miyakawa et al. | |
| 5,541,712 | A | 7/1996 | Fujitaka et al. | |
| 5,625,442 | A | 4/1997 | Seki | |
| 5,749,037 | A | 5/1998 | Takayuki | |
| 2006/0257183 | A1 | 11/2006 | Ehara et al. | |
| 2012/0177388 | A1 | 7/2012 | Imada et al. | |
| 2014/0341621 | A1* | 11/2014 | Omori | G03G 15/2028 399/329 |
| 2016/0004197 | A1 | 1/2016 | Imada et al. | |
| 2016/0098003 | A1 | 4/2016 | Uchitani et al. | |
| 2016/0147185 | A1 | 5/2016 | Hase et al. | |
| 2016/0161890 | A1 | 6/2016 | Shoji et al. | |
| 2016/0187823 | A1 | 6/2016 | Seto et al. | |
| 2016/0223961 | A1 | 8/2016 | Takagi et al. | |
| 2016/0223963 | A1 | 8/2016 | Yoshinaga et al. | |
| 2016/0231672 | A1 | 8/2016 | Seto et al. | |
| 2016/0238975 | A1 | 8/2016 | Seki et al. | |
| 2016/0246228 | A1 | 8/2016 | Fujimoto et al. | |
| 2016/0274510 | A1 | 9/2016 | Hase et al. | |
| 2016/0274511 | A1 | 9/2016 | Ogino et al. | |
| 2016/0274514 | A1 | 9/2016 | Ishii et al. | |
| 2016/0274516 | A1 | 9/2016 | Yamaguchi et al. | |
| 2016/0327891 | A1 | 11/2016 | Ikebuchi et al. | |
| 2016/0334742 | A1 | 11/2016 | Kobashigawa et al. | |
| 2016/0378027 | A1 | 12/2016 | Sawada et al. | |
| 2016/0378033 | A1 | 12/2016 | Ishigaya et al. | |
| 2017/0003633 | A1 | 1/2017 | Hase et al. | |
| 2017/0010570 | A1 | 1/2017 | Fujimoto et al. | |
| 2017/0010571 | A1 | 1/2017 | Matsuda et al. | |
| 2017/0017182 | A1 | 1/2017 | Saito et al. | |
| 2017/0102652 | A1 | 4/2017 | Imada et al. | |
| 2017/0123357 | A1 | 5/2017 | Shimada et al. | |
| 2017/0176899 | A1 | 6/2017 | Okamoto et al. | |
| 2017/0176906 | A1 | 6/2017 | Sawada et al. | |
| 2017/0176907 | A1 | 6/2017 | Sawada et al. | |
| 2017/0185009 | A1 | 6/2017 | Yoshinaga et al. | |
| 2017/0185015 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0205742 | A1 | 7/2017 | Shoji et al. | |
| 2017/0255147 | A1 | 9/2017 | Seki et al. | |
| 2017/0261900 | A1 | 9/2017 | Sawada et al. | |
| 2017/0285542 | A1 | 10/2017 | Hase et al. | |
| 2018/0067432 | A1* | 3/2018 | Yamaguchi | G03G 15/2085 |

OTHER PUBLICATIONS

U.S. Appl. No. 15/627,693, filed Jun. 20, 2017 Hiroshi Yoshinaga, et al.

U.S. Appl. No. 15/627,704, filed Jun. 20, 2017 Kazunari Sawada, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2016-236971, filed on Dec. 6, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

DESCRIPTION OF THE BACKGROUND

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a belt that is endless and flexible. The belt is rotatable in a rotation direction to convey a recording medium to fix a toner image on the recording medium. The belt includes an inner circumferential surface applied with a lubricant. A pressure rotator is rotatable and disposed opposite an outer circumferential surface of the belt. A heater heats the belt. A nip formation unit is disposed opposite the inner circumferential surface of the belt. The nip formation unit forms a fixing nip between the belt and the pressure rotator. The nip formation unit includes a guide face disposed upstream from the fixing nip in the rotation direction of the belt and contoured to separate from the pressure rotator in a direction opposite the rotation direction of the belt. The guide face is adhered with the lubricant moved from the inner circumferential surface of the belt. A controller performs a lubricant movement mode in which the belt rotates in the rotation direction when the outer circumferential surface of the belt has a temperature lower than a fixing temperature at which the belt fixes the toner image on the recording medium to cause the belt rotating in the rotation direction to bring the lubricant adhered to the guide face into contact with the belt.

This specification further describes an improved image forming apparatus. In one embodiment, the image forming apparatus includes an image forming device to form a toner image and a belt that is endless and flexible. The belt is rotatable in a rotation direction to convey a recording medium to fix the toner image on the recording medium. The belt includes an inner circumferential surface applied with a lubricant. A pressure rotator is rotatable and disposed opposite an outer circumferential surface of the belt. A heater heats the belt. A nip formation unit is disposed opposite the inner circumferential surface of the belt. The nip formation unit forms a fixing nip between the belt and the pressure rotator. The nip formation unit includes a guide face disposed upstream from the fixing nip in the rotation direction of the belt and contoured to separate from the pressure rotator in a direction opposite the rotation direction of the belt. The guide face is adhered with the lubricant moved from the inner circumferential surface of the belt. A controller performs a lubricant movement mode in which the belt rotates in the rotation direction when the outer circumferential surface of the belt has a temperature lower than a fixing temperature at which the belt fixes the toner image on the recording medium to cause the belt rotating in the rotation direction to bring the lubricant adhered to the guide face into contact with the belt.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
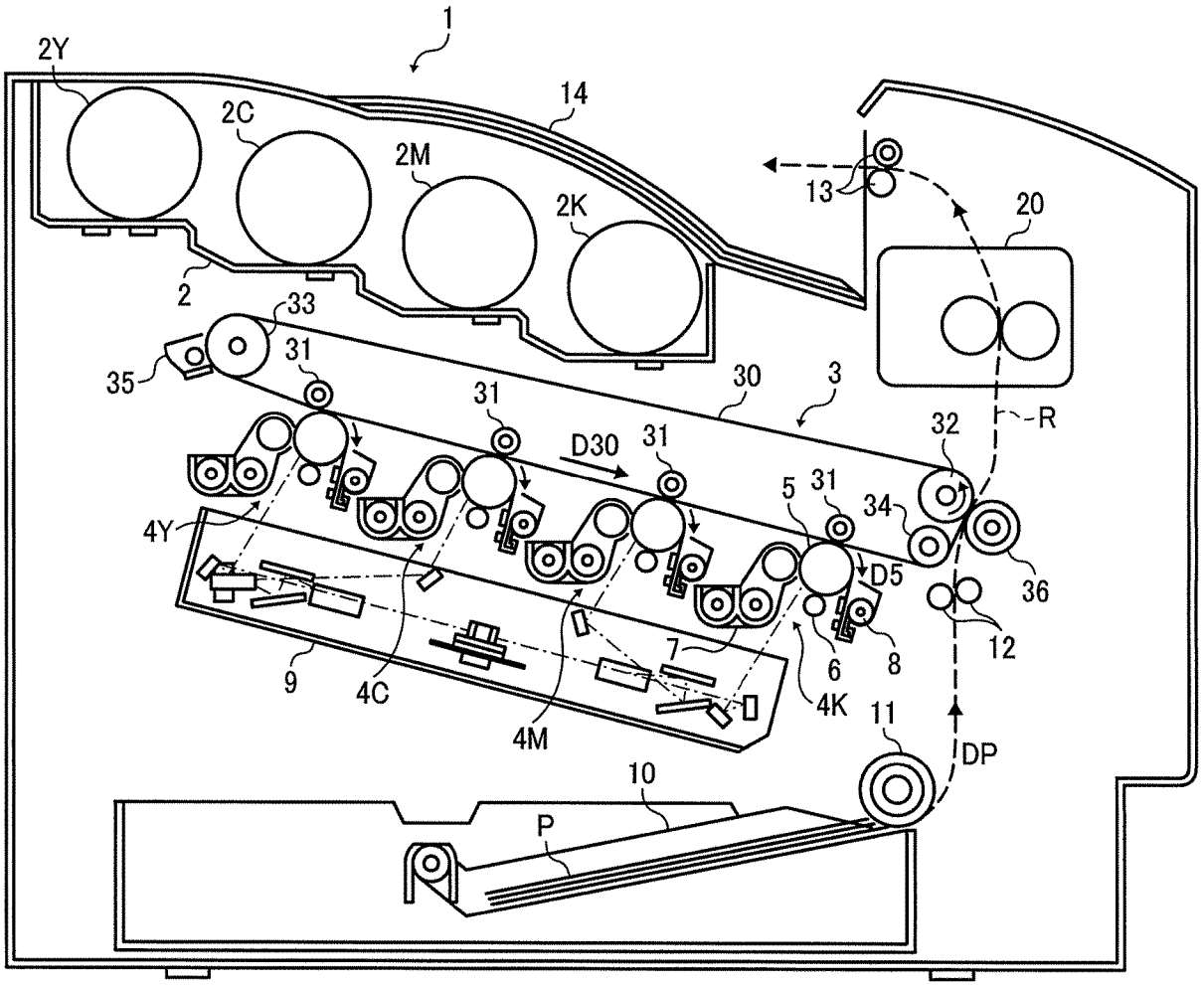
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least two of copying, printing, scanning, facsimile, and plotter functions, or the like. According to this embodiment, the image forming apparatus 1 is a color printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 is a color laser printer including four image forming devices 4Y, 4C, 4M, and 4K situated in a center portion of the image forming apparatus 1. The image forming devices 4Y, 4C, 4M, and 4K are aligned in a stretch direction in which an intermediate transfer belt 30 is stretched. Although the image forming devices 4Y, 4C, 4M, and 4K contain developers in different colors, that is, yellow, cyan, magenta, and black corresponding to color separation components of a color image (e.g., yellow, cyan, magenta, and black toners), respectively, the image forming devices 4Y, 4C, 4M, and 4K have an identical structure.

For example, each of the image forming devices 4Y, 4C, 4M, and 4K, serving as an image forming station, includes a photoconductor 5 that is drum-shaped and serves as a latent image bearer or an image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted.

Below the image forming devices 4Y, 4C, 4M, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4C, 4M, and 4K is a transfer device 3. For example, the transfer device 3 includes the intermediate transfer belt 30 serving as a transferor, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A bottle holder 2 situated in an upper portion of the image forming apparatus 1 accommodates four toner bottles 2Y, 2C, 2M, and 2K detachably attached to the bottle holder 2. The toner bottles 2Y, 2C, 2M, and 2K contain fresh yellow, cyan, magenta, and black toners to be supplied to the developing devices 7 of the image forming devices 4Y, 4C, 4M, and 4K, respectively. For example, the fresh yellow, cyan, magenta, and black toners are supplied from the toner bottles 2Y, 2C, 2M, and 2K to the developing devices 7 through toner supply tubes interposed between the toner bottles 2Y, 2C, 2M, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. Optionally, the image forming apparatus 1 may incorporate a bypass tray that loads a plurality of sheets P.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located upstream from the secondary transfer nip formed between the secondary transfer roller 36 and the intermediate transfer belt 30 in a sheet conveyance direction DP. The registration roller pair 12 serving as a conveyor conveys the sheet P conveyed from the feed roller 11 toward the secondary transfer nip.

The conveyance path R is further provided with a fixing device 20 located downstream from the secondary transfer nip in the sheet conveyance direction DP. The fixing device 20 fixes an unfixed toner image, which is transferred from the intermediate transfer belt 30 onto the sheet P, on the sheet P. The conveyance path R is further provided with the output roller pair 13 located downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4C, 4M, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, cyan, magenta, and black image data constructing color image data sent from the external device, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, cyan, magenta, and black toner images formed on the photoconductors 5 reach the primary transfer nips, respectively, in accordance with rotation of the photoconductors 5, the yellow, cyan, magenta, and black toner images are primarily transferred from the photoconductors 5 onto the intermediate transfer belt 30 by the transfer electric field created at the primary transfer nips such that the yellow, cyan, magenta, and black toner images are superimposed successively on a same position on the intermediate transfer belt 30. Thus, a full color toner image is formed on the outer circumferential surface of the intermediate transfer belt 30. After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, cyan, magenta, and black toners constructing the full color toner image formed on the intermediate transfer belt 30, thus creating a transfer electric field at the secondary transfer nip.

As the yellow, cyan, magenta, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, cyan, magenta, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container situated inside the image forming apparatus 1.

Thereafter, the sheet P bearing the full color toner image is conveyed to the fixing device 20 that fixes the full color toner image on the sheet P. Thereafter, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

Figure 2:
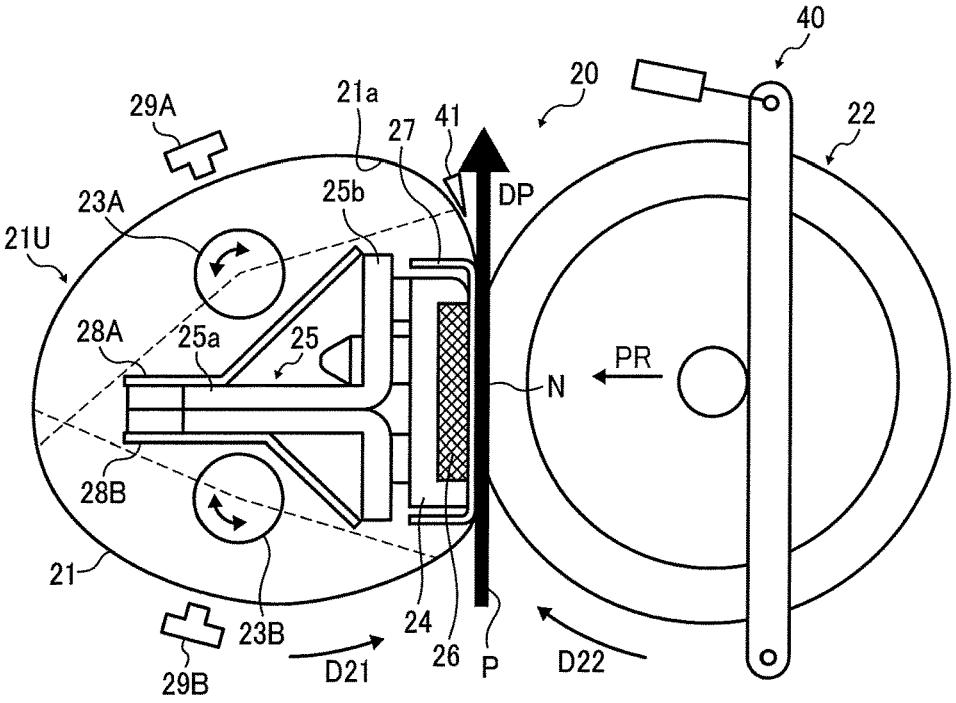
FIG. 2 is a schematic vertical cross-sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. The fixing device 20 (e.g., a fuser or a fusing unit) includes a fixing belt 21 and a pressure roller 22. The fixing belt 21, serving as a fixing rotator or a fixing member, is an endless belt that is thin, flexible, tubular, and rotatable in a rotation direction D21. The pressure roller 22, serving as a pressure rotator or a pressure member, contacts an outer circumferential surface of the fixing belt 21. The pressure roller 22 is rotatable in a rotation direction D22. Inside a loop formed by the fixing belt 21 is a plurality of heaters or a plurality of fixing heaters, that is, a halogen heater 23A serving as a first halogen heater and a halogen heater 23B serving as a second halogen heater, that heats the fixing belt 21 with radiant heat. Each of the halogen heaters 23A and 23B is a radiant heater serving as a main heater or a fixing heater.

Inside the loop formed by the fixing belt 21 are a nip formation pad 24, a stay 25, lateral end heaters 26, a thermal conduction aid 27, and reflectors 28A and 28B. The components disposed inside the loop formed by the fixing belt 21, that is, the halogen heaters 23A and 23B, the nip formation pad 24, the stay 25, the lateral end heaters 26, the thermal conduction aid 27, and the reflectors 28A and 28B, may construct a belt unit 21U separably coupled with the pressure roller 22. The nip formation pad 24 presses against the pressure roller 22 via the fixing belt 21 to form a fixing nip N between the fixing belt 21 and the pressure roller 22. The stay 25, serving as a support, supports the nip formation pad 24.

A detailed description is now given of a configuration of the nip formation pad 24.

The nip formation pad 24 extending in a longitudinal direction thereof parallel to an axial direction of the fixing belt 21 is secured to and supported by the stay 25. Accordingly, even if the nip formation pad 24 receives pressure from the pressure roller 22, the stay 25 prevents the nip formation pad 24 from being bent by the pressure and therefore allows the nip formation pad 24 to produce a uniform nip length of the fixing nip N throughout the entire width of the pressure roller 22 in an axial direction or a longitudinal direction thereof.

The nip formation pad 24 is made of a heat resistant material being resistant against temperatures up to 200 degrees centigrade and having an enhanced mechanical strength. For example, the nip formation pad 24 is made of heat resistant resin such as polyimide (PI), polyether ether ketone (PEEK), and PI or PEEK reinforced with glass fiber. Thus, the nip formation pad 24 is immune from thermal deformation at temperatures in a fixing temperature range desirable to fix a toner image on a sheet P, retaining the shape of the fixing nip N and quality of the toner image formed on the sheet P. Both lateral ends of the stay 25 and the halogen heaters 23A and 23B in a longitudinal direction thereof are secured to and supported by a pair of side plates of the fixing device 20 or a pair of holders, provided separately from the pair of side plates, respectively.

A detailed description is now given of a configuration of the thermal conduction aid 27.

Figure 3:
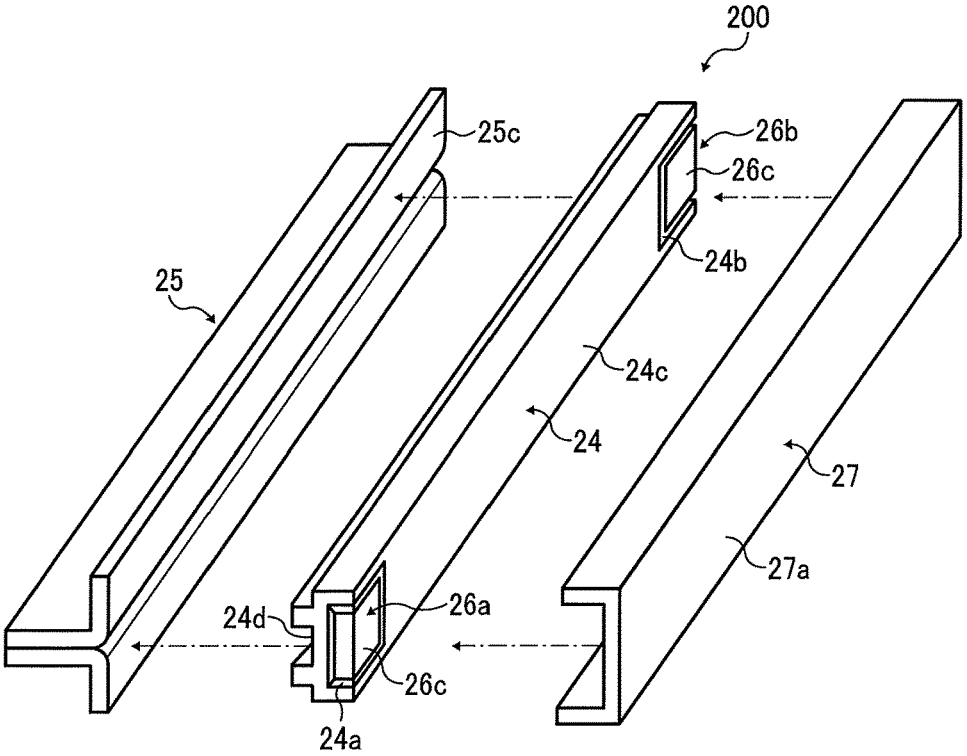
FIG. 3 is an exploded perspective view of a nip formation unit incorporated in the fixing device depicted in FIG. 2.

The thermal conduction aid 27 also serves as a thermal equalizer that facilitates conduction of heat in the axial direction of the fixing belt 21. FIG. 3 is an exploded perspective view of the thermal conduction aid 27, the nip formation pad 24, the stay 25, and lateral end heaters 26*a* and 26*b* illustrated as the lateral end heaters 26 in FIG. 2. As illustrated in FIG. 3, the thermal conduction aid 27 covers a belt-side face 24*c*, that is, an opposed face, of the nip formation pad 24, which is disposed opposite an inner circumferential surface 21*a* of the fixing belt 21 depicted in FIG. 2. The thermal conduction aid 27 conducts and equalizes heat in a longitudinal direction of the thermal conduction aid 27 that is parallel to the axial direction of the fixing belt 21, preventing heat from being stored at both lateral ends of the fixing belt 21 in the axial direction thereof while a plurality of small sheets P is conveyed over the fixing belt 21. Thus, the thermal conduction aid 27 eliminates uneven temperature of the fixing belt 21 in the axial direction thereof. Hence, the thermal conduction aid 27 is made of a material that conducts heat quickly, for example, a material having an enhanced thermal conductivity such as copper having a thermal conductivity of 398 W/mk and aluminum having a thermal conductivity of 236 W/mk.

As illustrated in FIG. 3, the thermal conduction aid 27 includes a belt-side face 27*a* being disposed opposite and in direct contact with the inner circumferential surface 21*a* of the fixing belt 21. Thus, the belt-side face 27*a* serves as a nip formation face that forms the fixing nip N. The belt-side face 27*a* is planar. Alternatively, the belt-side face 27*a* may be curved or recessed or may have other shapes. If the belt-side face 27*a* is recessed with respect to the pressure roller 22, the belt-side face 27*a* directs a leading edge of the sheet P toward the pressure roller 22 as the sheet P is ejected from the fixing nip N, facilitating separation of the sheet P from the fixing belt 21 and suppressing jamming of the sheet P between the fixing belt 21 and the pressure roller 22. The sheets P may be thick paper, postcards, envelopes, plain paper, thin paper, coated paper, art paper, tracing paper, overhead projector (OHP) transparencies, and the like.

As illustrated in FIG. 2, temperature sensors 29A and 29B are disposed opposite the outer circumferential surface of the fixing belt 21 at proper positions thereon, for example, positions where the temperature sensors 29A and 29B are disposed opposite the halogen heaters 23A and 23B, respectively, via the fixing belt 21. The temperature sensors 29A and 29B serve as a temperature detector that detects the temperature of the fixing belt 21. A separator 41 is disposed downstream from the fixing nip N in the sheet conveyance direction DP to separate the sheet P from the fixing belt 21. A pressurization assembly 40 presses the pressure roller 22 against the nip formation pad 24 via the fixing belt 21 and releases pressure exerted by the pressure roller 22 to the fixing belt 21.

A detailed description is now given of a construction of the fixing belt 21.

In order to decrease the thermal capacity of the fixing belt 21, the fixing belt 21, that is, an endless belt being thin like film and having a downsized loop diameter, is constructed of a base layer serving as the inner circumferential surface 21*a* of the fixing belt 21 and a release layer serving as the outer circumferential surface of the fixing belt 21. The base layer is made of metal such as nickel and SUS stainless steel or resin such as PI. The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image on the sheet P to fix the toner image on the sheet P, the elastic layer having a thickness of about 100 micrometers elastically deforms to absorb slight surface asperities of the fixing belt 21, preventing variation in gloss of the toner image on the sheet P.

In order to decrease the thermal capacity of the fixing belt 21, the fixing belt 21 has a total thickness not greater than 1 mm and a loop diameter in a range of from 20 mm to 40 mm. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. In order to decrease the thermal capacity of the fixing belt 21 further, the fixing belt 21 may have a total thickness not greater than 0.20 mm and preferably not greater than 0.16 mm. The loop diameter of the fixing belt 21 is not greater than 30 mm.

A detailed description is now given of a construction of the stay 25.

The stay 25, having a T-shape in cross-section, includes a base 25*b* disposed opposite the fixing nip N and an arm 25*a* projecting from the base 25*b* and being disposed opposite the nip formation pad 24 via the base 25*b*. In other words, the arm 25*a* of the stay 25 projects from the nip formation pad 24 in a pressurization direction PR in which the pressure roller 22 presses against the nip formation pad 24 via the fixing belt 21. The arm 25*a* is interposed between the halogen heaters 23A and 23B serving as the main heater to screen the halogen heater 23A from the halogen heater 23B.

A detailed description is now given of a construction of the halogen heaters 23A and 23B.

The halogen heater 23A includes a center heat generator disposed in a center span of the halogen heater 23A in the longitudinal direction thereof. A small sheet P is disposed opposite the center heat generator of the halogen heater 23A. The halogen heater 23B includes a lateral end heat generator disposed in each lateral end span of the halogen heater 23B in the longitudinal direction thereof. A large sheet P is disposed opposite the lateral end heat generator of the halogen heater 23B.

The stay 25 that is T-shaped in cross-section is interposed between the two halogen heaters 23A and 23B to screen the halogen heater 23A from the halogen heater 23B. Accordingly, compared to a configuration in which a plurality of halogen heaters is aligned, the stay 25 prevents the halogen heaters 23A and 23B from heating each other, improving heating efficiency of the halogen heaters 23A and 23B. The power supply situated inside the image forming apparatus 1 supplies power to the halogen heaters 23A and 23B so that the halogen heaters 23A and 23B generate heat.

Figure 4:
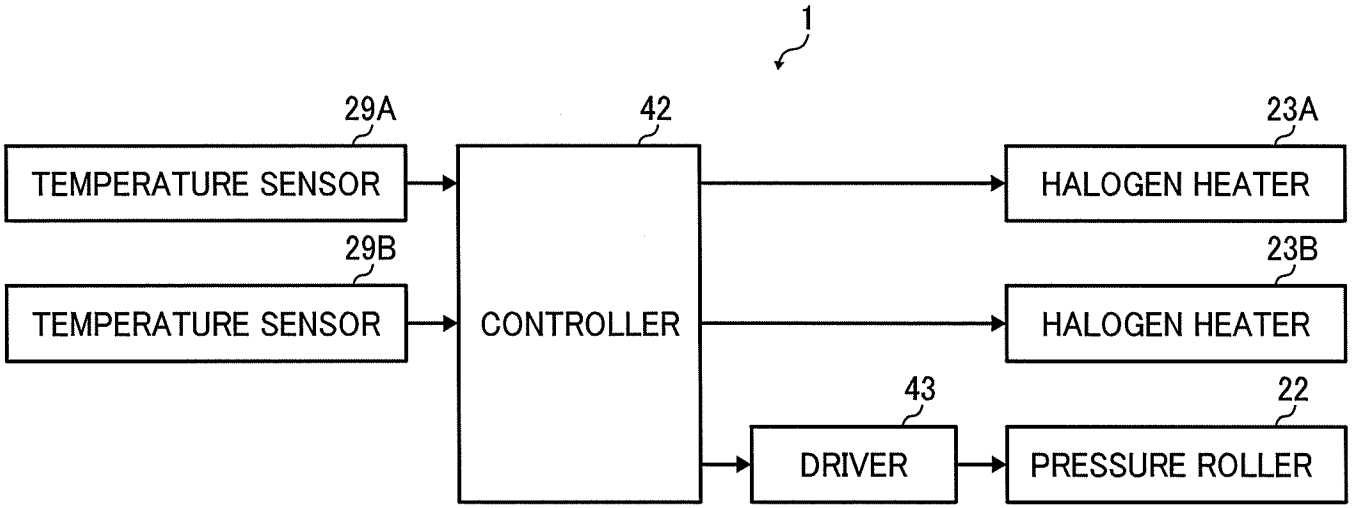
FIG. 4 is a block diagram of the image forming apparatus depicted in FIG. 1.

FIG. 4 is a block diagram of the image forming apparatus 1. As illustrated in FIG. 4, a controller 42 (e.g., a processor), that is, a central processing unit (CPU) provided with a random-access memory (RAM) and a read-only memory (ROM), for example, operatively connected to the halogen heaters 23A and 23B and the temperature sensors 29A and 29B controls the halogen heaters 23A and 23B based on the temperature of the outer circumferential surface of the fixing belt 21 that is detected by the temperature sensors 29A and 29B disposed opposite the outer circumferential surface of the fixing belt 21. The controller 42 may be disposed inside the fixing device 20 or the image forming apparatus 1. Thus, the temperature of the fixing belt 21 is adjusted to a desired fixing temperature.

A detailed description is now given of a configuration of the reflectors 28A and 28B.

As illustrated in FIG. 2, the reflector 28A is interposed between the halogen heater 23A and the stay 25. The reflector 28B is interposed between the halogen heater 23B and the stay 25. The reflectors 28A and 28B reflect light and heat radiated from the halogen heaters 23A and 23B to the reflectors 28A and 28B, respectively, toward the fixing belt 21, thus enhancing heating efficiency of the halogen heaters 23A and 23B to heat the fixing belt 21. Additionally, the reflectors 28A and 28B prevent light and heat radiated from the halogen heaters 23A and 23B from heating the stay 25 with radiant heat, suppressing waste of energy. Alternatively, instead of the reflectors 28A and 28B, an opposed face of the stay 25 disposed opposite the halogen heaters 23A and 23B may be treated with insulation or mirror finish to reflect light and heat radiated from the halogen heaters 23A and 23B to the stay 25 toward the fixing belt 21.

A detailed description is now given of a construction of the pressure roller 22.

The pressure roller 22 is constructed of a core bar; an elastic layer coating the core bar and being made of silicone rubber foam, fluoro rubber, or the like; and a release layer coating the elastic layer and being made of PFA, PTFE, or the like. The pressurization assembly 40 including a spring presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction DP.

A driver 43 (e.g., a motor) depicted in FIG. 4 disposed inside the image forming apparatus 1 drives and rotates the pressure roller 22. As the driver 43 drives and rotates the pressure roller 22, a driving force of the driver 43 is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver 43 may also be connected to the fixing belt 21 to drive and rotate the fixing belt 21. At the fixing nip N, the fixing belt 21 rotates as the fixing belt 21 is sandwiched between the pressure roller 22 and the nip formation pad 24; at a circumferential span of the fixing belt 21 other than the fixing nip N, the fixing belt 21 rotates while the fixing belt 21 is guided by a flange that is in contact with each lateral end of the fixing belt 21 in the axial direction thereof and is mounted on the side plate of the fixing device 20.

According to this embodiment, the pressure roller 22 is a solid roller. Alternatively, the pressure roller 22 may be a hollow roller. In this case, a heater such as a halogen heater may be disposed inside the hollow roller. The elastic layer of the pressure roller 22 may be made of solid rubber. Alternatively, if no heater is situated inside the pressure roller 22, the elastic layer of the pressure roller 22 may be made of sponge rubber. The sponge rubber is more preferable than the solid rubber because the sponge rubber has an increased insulation that draws less heat from the fixing belt 21.

Referring to FIG. 3, a description is provided of a construction of a nip formation unit 200 incorporated in the fixing device 20 depicted in FIG. 2.

FIG. 3 is an exploded perspective view of the nip formation unit 200, illustrating a basic structure of the nip formation unit 200. As illustrated in FIG. 3, the nip formation unit 200 includes the nip formation pad 24, the stay 25, the thermal conduction aid 27, and the lateral end heaters 26*a* and 26*b* illustrated as the lateral end heaters 26 in FIG. 2. The nip formation pad 24 includes the belt-side face 24*c* disposed opposite the fixing nip N and the inner circumferential surface 21*a* of the fixing belt 21 and a stay-side face 24*d* being opposite the belt-side face 24*c* and disposed opposite the stay 25. The stay 25 includes a belt-side face 25*c* being planar and disposed opposite the fixing nip N and the inner circumferential surface 21*a* of the fixing belt 21.

The stay-side face 24*d* of the nip formation pad 24 contacts the belt-side face 25*c* of the stay 25. For example, the stay-side face 24*d* of the nip formation pad 24 and the belt-side face 25*c* of the stay 25 mount a recess and a projection (e.g., a boss and a pin), respectively, so that the stay-side face 24*d* engages the belt-side face 25*c* to restrict each other with the shape of the stay-side face 24*d* and the belt-side face 25*c*.

The thermal conduction aid 27 engages the nip formation pad 24 that is substantially rectangular such that the thermal conduction aid 27 covers the belt-side face 24*c* of the nip formation pad 24 that is disposed opposite the inner circumferential surface 21*a* of the fixing belt 21. Thus, the thermal conduction aid 27 is coupled with the nip formation pad 24. For example, the thermal conduction aid 27 is coupled with the nip formation pad 24 with a claw, an adhesive, or the like.

A detailed description is now given of a configuration of the lateral end heaters 26*a* and 26*b*.

The nip formation pad 24 includes recesses 24*a* and 24*b*, serving as steps, disposed at both lateral ends of the nip formation pad 24, respectively, in the longitudinal direction of the nip formation pad 24. The recesses 24*a* and 24*b* accommodate the lateral end heaters 26*a* and 26*b*, respectively, to couple the lateral end heaters 26*a* and 26*b* with the nip formation pad 24. The lateral end heaters 26*a* and 26*b* serve as a sub heater provided separately from the main heater or the fixing heater (e.g., the halogen heaters 23A and 23B). The lateral end heaters 26*a* and 26*b* heat both lateral ends of an extension size sheet greater than a maximum standard size sheet in the longitudinal direction of the nip formation pad 24, respectively. Each of the lateral end heaters 26*a* and 26*b* is a contact heater that contacts the thermal conduction aid 27 to conduct heat to the fixing belt 21, for example, a resistive heat generator such as a ceramic heater.

The thermal conduction aid 27 includes the belt-side face 27*a* that is disposed opposite the inner circumferential surface 21*a* of the fixing belt 21. The belt-side face 27*a* serves as a slide face over which the fixing belt 21 slides. However, since a mechanical strength of the belt-side face 24*c* of the nip formation pad 24 is greater than a mechanical strength of the belt-side face 27*a* of the thermal conduction aid 27, the belt-side face 24*c* of the nip formation pad 24 serves as a nip formation face that is disposed opposite the pressure roller 22 and forms the fixing nip N practically.

Since the inner circumferential surface 21*a* of the fixing belt 21 slides over the belt-side face 27*a* of the thermal conduction aid 27, the belt-side face 27*a* is smooth. In order to facilitate sliding of the fixing belt 21 over the thermal conduction aid 27 further, the belt-side face 27*a* is treated with processing to reduce friction. For example, the belt-side face 27*a* is coated with a fluorine material such as PFA and PTFE or treated with other coating to retain proper sliding of the inner circumferential surface 21*a* of the fixing belt 21 over the belt-side face 27*a* of the thermal conduction aid 27. A lubricant such as fluorine grease and silicone oil is applied between the thermal conduction aid 27 and the inner circumferential surface 21*a* of the fixing belt 21 to decrease a sliding torque.

According to this embodiment, the lateral end heaters 26*a* and 26*b* are coupled with the nip formation pad 24 to form the fixing nip N. Hence, the lateral end heaters 26*a* and 26*b* are situated inside a limited space inside the loop formed by the fixing belt 21, saving space. Each of the lateral end heaters 26*a* and 26*b* includes a belt-side face 26*c* disposed opposite the inner circumferential surface 21*a* of the fixing belt 21. The belt-side face 26*c* of each of the lateral end heaters 26*a*and 26*b* is leveled with the belt-side face 24*c* of the nip formation pad 24 that is disposed opposite the inner circumferential surface 21*a* of the fixing belt 21 in the pressurization direction PR depicted in FIG. 2 in which the pressure roller 22 presses against the nip formation pad 24 so that the belt-side faces 26*c* and the belt-side face 24*c* define an identical plane. Accordingly, the pressure roller 22 is pressed against the lateral end heaters 26*a* and 26*b* via the fixing belt 21 and the thermal conduction aid 27 sufficiently. Consequently, the fixing belt 21 rotates stably in a state in which the fixing belt 21 is pressed against the lateral end heaters 26*a* and 26*b* or adhered to the lateral end heaters 26*a* and 26*b* indirectly via the thermal conduction aid 27. The fixing belt 21 is pressed against the lateral end heaters 26*a* and 26*b* with sufficient pressure, retaining improved heating efficiency of the lateral end heaters 26*a* and 26*b*.

A description is provided of a construction of a first comparative fixing device and a second comparative fixing device.

The first comparative fixing device includes a thin, flexible endless belt having a low thermal capacity, a nip formation unit stationarily disposed inside a loop formed by the belt, and a pressure rotator. The pressure rotator is pressed against the nip formation unit via the belt to form a fixing nip between the belt and the pressure rotator.

Since an inner circumferential surface of the belt slides over the nip formation unit, a lubricant may be applied to the inner circumferential surface of the belt to decrease a frictional load imposed on the belt while the belt slides over the nip formation unit. However, while the belt rotates and passes through the fixing nip, the nip formation unit scrapes the lubricant applied to the inner circumferential surface of the belt off the belt at an entry and an exit of the fixing nip. The scraped lubricant accumulates on the nip formation unit at a position outside the fixing nip. Accordingly, the amount of the lubricant adhered to the inner circumferential surface of the belt decreases over time, thus increasing the frictional load imposed on the belt. If the frictional load imposed on the belt increases excessively, the belt and the pressure rotator that rotates the belt may suffer from breakage.

To address this circumstance, the second comparative fixing device includes a belt, a driver, a slide member equivalent to the nip forming unit, and a controller. A pressurization mechanism changes pressure with which the driver and the slide member sandwich the belt between first pressure and second pressure smaller than the first pressure. The controller performs a lubricant movement mode. In the lubricant movement mode, the pressurization mechanism presses the driver against the belt with the second pressure and the driver rotates the belt in a predetermined rotation direction with slippage of the belt relative to the driver. The pressurization mechanism presses the driver against the belt with the first pressure and the driver rotates the belt to slide over a slide portion of the slide member to move a lubricant accumulated at a position upstream from the slide portion in the rotation direction of the belt to a gap between the belt and the slide portion.

The controller temporarily decreases pressure with which the driver and the slide member sandwich the belt, decreasing a frictional driving force defined by multiplying a coefficient of friction by pressure and generated between the driver and the belt. Thus, the controller intentionally rotates the belt with slippage. Accordingly, the controller produces circulation of the lubricant, which is different from regular movement of the lubricant while the belt rotates regularly, replacing the lubricant.

However, slippage of the belt varies depending on a relation of the magnitude between the frictional driving force transmitted from the driver to the belt and a frictional sliding force between the belt and the slide member. For example, as pressure with which the driver and the slide member sandwich the belt decreases and the frictional sliding force is substantially greater than the frictional driving force, the driver slips relative to the belt, halting the belt. Accordingly, the lubricant does not move advantageously. Additionally, if the magnitude of the frictional sliding force varies in a longitudinal direction of the belt, a part of the belt may rotate and another part of the belt may halt, resulting in distortion and breakage of the belt.

To address this circumstance, the fixing device 20 has a configuration described below that adheres a lubricant accumulated on the nip formation unit 200 at a position outside the fixing nip N to the inner circumferential surface 21*a* of the fixing belt 21 again without slippage of the fixing belt 21.

A description is provided of a configuration of a periphery of the fixing nip N of the fixing device 20.

Figure 5:
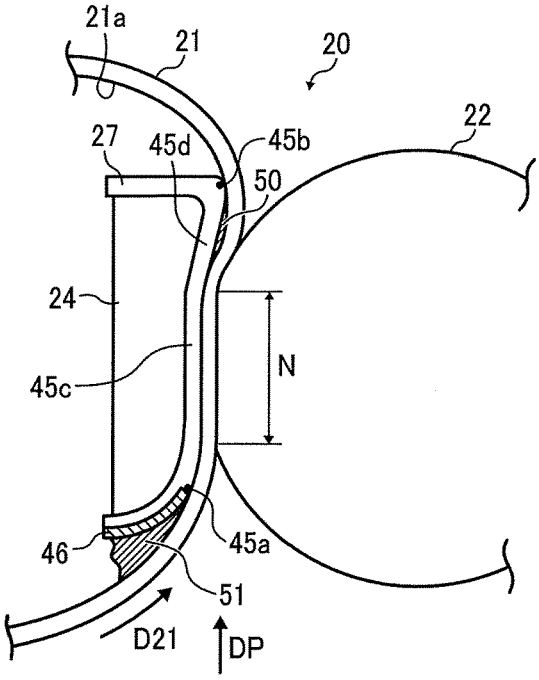
FIG. 5 is a partial vertical cross-sectional view of the fixing device depicted in FIG. 2, illustrating a periphery of a fixing nip.

FIG. 5 is a partial vertical cross-sectional view of the fixing device 20, illustrating the periphery of the fixing nip N. Identical reference numerals are assigned to components illustrated in FIG. 5 that are identical to the components illustrated in FIG. 2 and description of the identical components is omitted.

As illustrated in FIG. 5, as the driver 43 depicted in FIG. 4 drives and rotates the pressure roller 22, a driving force of the driver 43 is transmitted from the pressure roller 22 to the fixing belt 21 at the fixing nip N, thus rotating the fixing belt 21 in accordance with rotation of the pressure roller 22. Accordingly, the thermal conduction aid 27 includes an upstream abutment 45*a* that contacts the fixing belt 21 and defines a curvature of the fixing belt 21, which prevents breakage of the fixing belt 21. The thermal conduction aid 27 further includes a guide face 46 extending from the upstream abutment 45*a* in a direction opposite the rotation direction D21 of the fixing belt 21 such that the guide face 46 separates from the pressure roller 22 farther from the fixing nip N. The thermal conduction aid 27 further includes a nip portion 45*c* that forms the fixing nip N. The guide face 46 adjoins the nip portion 45*c* through the upstream abutment 45*a* such that the guide face 46 is contiguous to the nip portion 45*c* through the upstream abutment 45*a* seamlessly.

Figure 6:
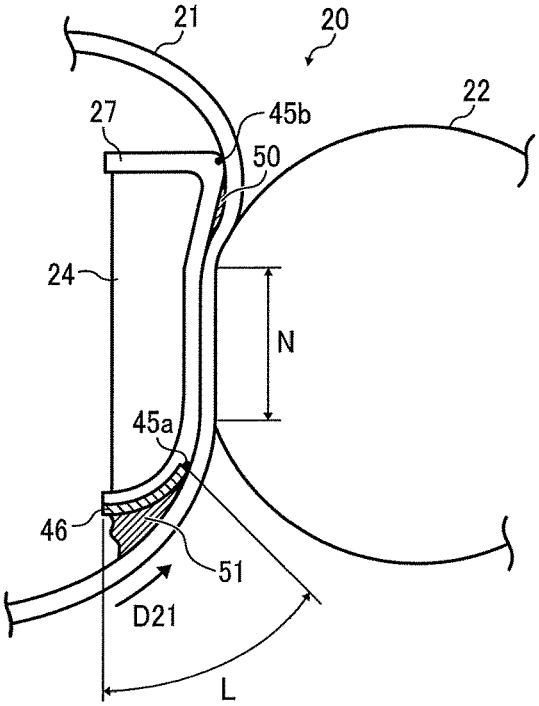
FIG. 6 is a partial vertical cross-sectional view of the fixing device depicted in FIG. 5, illustrating one example of the dimension of the fixing nip and a guide face.

FIG. 6 is a partial vertical cross-sectional view of the fixing device 20, illustrating one example of the dimension of the fixing nip N and the guide face 46. As illustrated in FIG. 6, the fixing nip N has a length in a range of from 9 mm to 11 mm in the rotation direction D21 of the fixing belt 21. The guide face 46 has a length L in a range of from 5 mm to 7 mm in the rotation direction D21 of the fixing belt 21.

As illustrated in FIG. 5, the thermal conduction aid 27 further includes a downstream face 45*d* disposed downstream from the fixing nip N in the sheet conveyance direction DP. The downstream face 45*d* tilts or projects toward the pressure roller 22. The downstream face 45*d* increases the curvature of the fixing belt 21 locally to prevent the sheet P that has passed through the fixing nip N from being adhered to and wound around the fixing belt 21 by the viscosity of toner of the toner image on the sheet P as the toner is melted under heat, thus preventing the sheet P from being jammed between the fixing belt 21 and the pressure roller 22. The downstream face 45*d* includes a downstream abutment 45*b* that contacts the fixing belt 21. The downstream abutment 45*b* projects toward the pressure roller 22 beyond other parts of the thermal conduction aid 27, that is, the guide face 46, the upstream abutment 45*a*, and the nip portion 45*c*.

With the above-described construction of the fixing device 20, while the fixing device 20 fixes the toner image on the sheet P, as the driver 43 drives and rotates the pressure roller 22, a frictional driving force of the driver 43 is transmitted from the pressure roller 22 to the fixing belt 21 at the fixing nip N. As the fixing belt 21 receives the frictional driving force, the fixing belt 21 is rotated by friction between the pressure roller 22 and the fixing belt 21 in a state in which the flange guides the fixing belt 21 at each lateral end of the fixing belt 21 in the axial direction thereof.

As the fixing belt 21 receives the frictional driving force, the fixing belt 21 is pulled into the fixing nip N. Accordingly, while the fixing belt 21 is exerted with tension at an entry to the fixing nip N, that is, at the upstream abutment 45*a*, the fixing belt 21 slackens at an exit of the fixing nip N, that is, at the downstream abutment 45*b*. Since tension exerted to the fixing belt 21 at the entry to the fixing nip N is greater than tension exerted to the fixing belt 21 at the exit of the fixing nip N, pressure with which the upstream abutment 45*a* contacts the fixing belt 21 is greater than pressure with which the downstream abutment 45*b* contacts the fixing belt 21.

Accordingly, the lubricant adhered to the fixing belt 21 passing through the fixing nip N where the fixing belt 21 is exerted with a great load moves over a slackened portion of the fixing belt 21 as a lubricant 50 and passes through a gap between the downstream abutment 45*b* and the fixing belt 21. Conversely, the lubricant accumulates easily on the guide face 46 and at a position upstream from the upstream abutment 45*a* as an accumulated lubricant 51.

The guide face 46 of the thermal conduction aid 27 retains the accumulated lubricant 51 and adheres the accumulated lubricant 51 to the fixing belt 21 again. A predetermined gap is provided between the guide face 46 and a rotation trajectory of the inner circumferential surface 21*a* of the fixing belt 21. The predetermined gap prevents the fixing belt 21 from sliding over the guide face 46, thus preventing breakage of the fixing belt 21 and increase in a driving load imposed on the fixing belt 21. Hence, the guide face 46 retains the accumulated lubricant 51 such that most of the accumulated lubricant 51 does not adhere to the fixing belt 21 again.

As the number of rotations of the fixing belt 21, which is equivalent to the number of prints, increases, the amount of the accumulated lubricant 51 increases. Hence, the amount of the lubricant adhered to the inner circumferential surface 21*a* of the fixing belt 21, that is, the amount of the lubricant that is circulated, decreases. As a result, the sliding friction between the fixing belt 21 and the thermal conduction aid 27 may increase, causing slippage and breakage of the fixing belt 21.

To address this circumstance, in order to bring the fixing belt 21 into contact with the accumulated lubricant 51 again, an experiment is performed to examine change in the rotation trajectory of the fixing belt 21 caused by the temperature of the outer circumferential surface of the fixing belt 21 and the rotation speed of the fixing belt 21.

Figure 7:
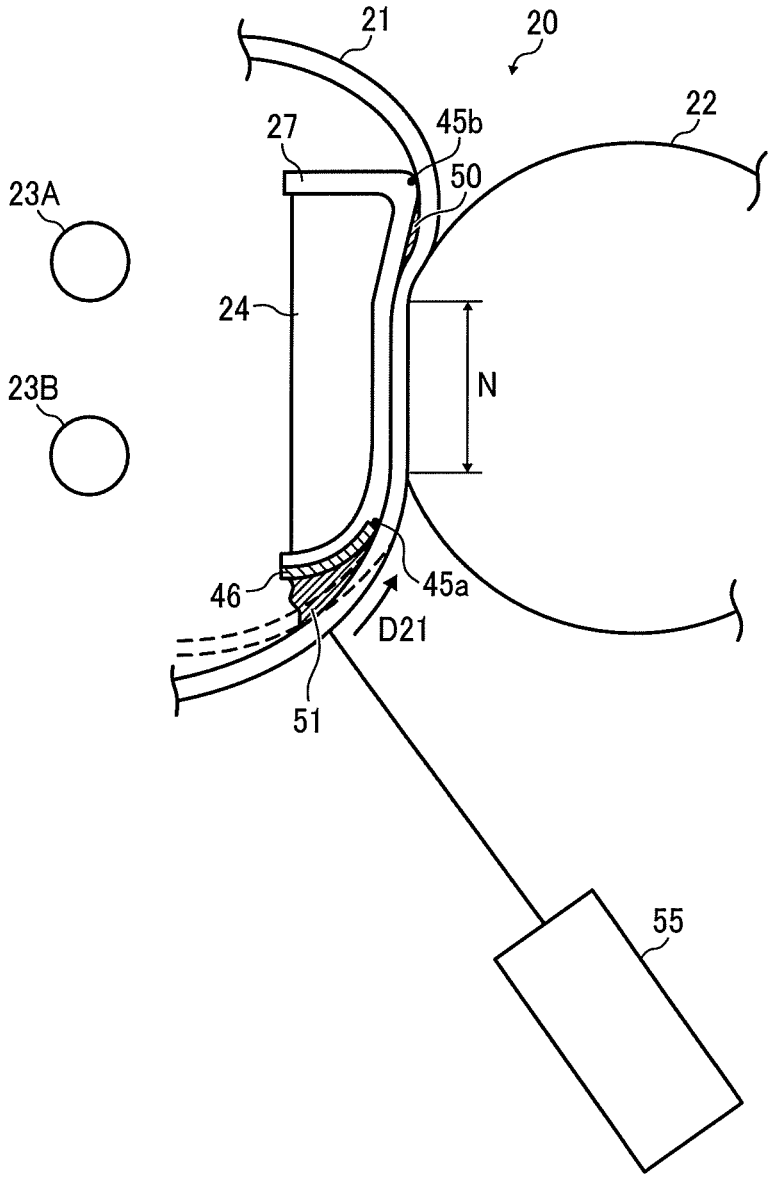
FIG. 7 is a partial vertical cross-sectional view of the fixing device depicted in FIG. 6, illustrating a mechanism used for an experiment.

Referring to FIG. 7, a description is provided of a method of the experiment that measures the rotation trajectory of the fixing belt 21.

FIG. 7 is a partial vertical cross-sectional view of the fixing device 20, illustrating a mechanism used for the experiment. Identical reference numerals are assigned to components illustrated in FIG. 7 that are identical to the components illustrated in FIGS. 5 and description of the identical components is omitted. As illustrated in FIG. 7, a laser displacement meter 55 is disposed opposite the fixing belt 21. The laser displacement meter 55 measures displacement of the fixing belt 21 rotating in the rotation direction D21 at a position in proximity to the guide face 46.

As a measurement condition, the fixing belt 21 rotates at three conveyance speeds, that is, rotation speeds, of 126 mm/s, 256 mm/s, and 392 mm/s to convey a sheet P. Simultaneously, the temperature of the fixing belt 21 changes in a range of from 20 degrees centigrade to 160 degrees centigrade. The number of rotations of the pressure roller 22 is adjusted to change the conveyance speed of the fixing belt 21. Turning on of the halogen heaters 23A and 23B disposed inside the loop formed by the fixing belt 21 is controlled to change the temperature of the fixing belt 21.

Figure 8A:
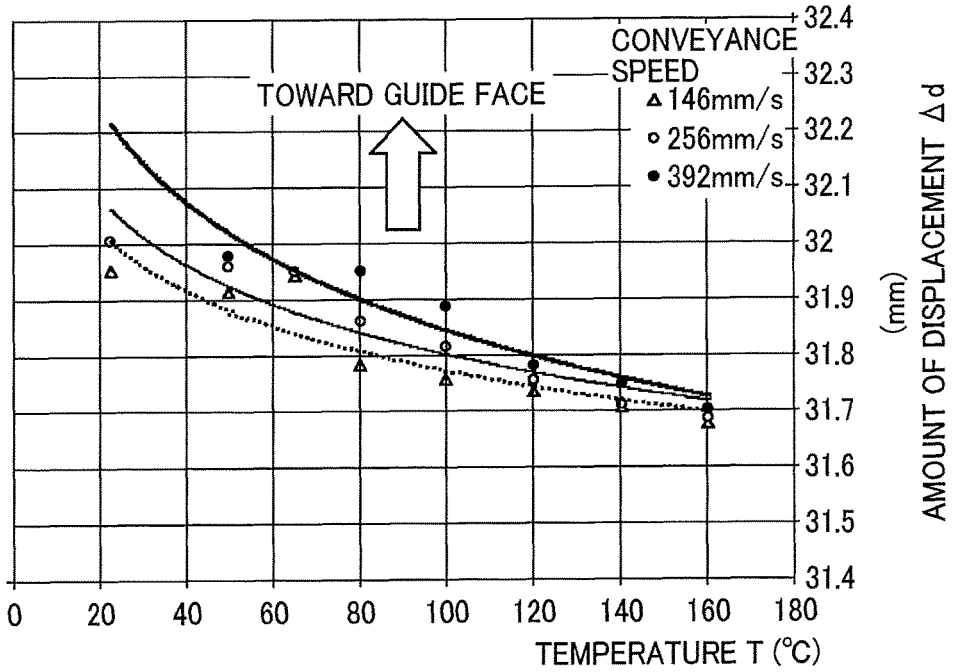
FIG. 8A is a graph illustrating a relation between the temperature of a fixing belt of the fixing device depicted in FIG. 7 and the amount of displacement of the fixing belt at substantially a center of a sheet conveyance span of the fixing belt in an axial direction thereof.
Figure 8B:
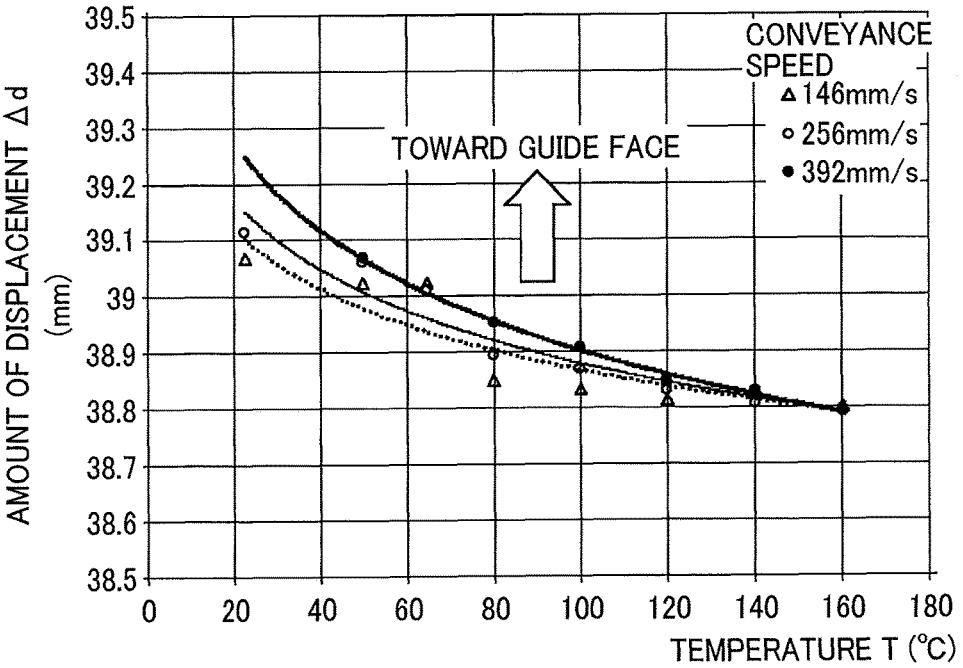
FIG. 8B is a graph illustrating a relation between the temperature of the fixing belt of the fixing device depicted in FIG. 7 and the amount of displacement of the fixing belt at a lateral end of the sheet conveyance span of the fixing belt in the axial direction thereof.

FIG. 8A is a graph illustrating a relation between the temperature of the fixing belt 21 and the amount of displacement of the fixing belt 21 at substantially a center of a sheet conveyance span of the fixing belt 21 in the axial direction thereof. FIG. 8B is a graph illustrating a relation between the temperature of the fixing belt 21 and the amount of displacement of the fixing belt 21 at a lateral end of the sheet conveyance span of the fixing belt 21 in the axial direction thereof. In FIGS. 8A and 8B, a horizontal axis represents a temperature T of the fixing belt 21 in Celsius. A vertical axis represents an amount of displacement Δd of the fixing belt 21 relative to the laser displacement meter 55 in millimeter. The greater the amount of displacement Δd is, the closer the fixing belt 21 is to the guide face 46 and the upstream abutment 45*a*. That is, the fixing belt 21 separates from the laser displacement meter 55 farther.

As illustrated in FIG. 8A, as the temperature T of the fixing belt 21 decreases, the amount of displacement Δd increases. Accordingly, the outer circumferential surface of the fixing belt 21 moves closer to the guide face 46 and the upstream abutment 45*a*. As the conveyance speed of the fixing belt 21 increases, the fixing belt 21 moves closer to the guide face 46 and the upstream abutment 45*a*.

For example, as illustrated in FIG. 7, compared to a condition in which the fixing belt 21 conveys the sheet P at the temperature T of 160 degrees centigrade and the conveyance speed of 256 mm/s, under a condition in which the fixing belt 21 conveys the sheet P at the etemperature T of 25 degrees centigrade and the conveyance speed of 392 mm/s, the outer circumferential surface of the fixing belt 21 passes through a trajectory disposed inward by about 0.5 mm as illustrated in a dotted line in FIG. 7.

FIG. 8B is a graph illustrating the relation between the temperature of the fixing belt 21 and the amount of displacement of the fixing belt 21 at the lateral end of the sheet conveyance span of the fixing belt 21 in the axial direction thereof. Both lateral ends of the fixing belt 21 in the axial direction thereof, since they are guided by the flanges, respectively, are allowed to move less flexibly than a center of the fixing belt 21 in the axial direction thereof. Accordingly, the amount of displacement Δd of both lateral ends of the fixing belt 21 in the axial direction thereof, although it is slightly smaller than the amount of displacement Δd of the center of the fixing belt 21 in the axial direction thereof illustrated in FIG. 8A, has a substantially similar result or tendency.

For example, compared to the condition in which the fixing belt 21 conveys the sheet P at the temperature T of 160 degrees centigrade and the conveyance speed of 256 mm/s, under the condition in which the fixing belt 21 conveys the sheet P at the temperature T of 25 degrees centigrade and the conveyance speed of 392 mm/s, the outer circumferential surface of the fixing belt 21 passes through a trajectory disposed inward by about 0.45 mm.

The conveyance speed of 256 mm/s illustrated in FIGS. 8A and 8B is a conveyance speed of the fixing belt 21 of the fixing device 20 according to this embodiment when the fixing belt 21 conveys plain paper as a sheet P. No conveyance speed higher than the conveyance speed of 256 mm/s is available in the fixing device 20. When the fixing device 20 fixes a toner image on thick paper having a thickness of 200 k, the fixing belt 21 conveys the thick paper at a conveyance speed lower than 256 mm/s to attain a predetermined fixing temperature. Hence, the rotation trajectory of the fixing belt 21 is most inward toward the guide face 46 at the conveyance speed of 256 mm/s.

A theoretical description is provided of reasons why the rotation trajectory of the fixing belt 21 is most inward toward the guide face 46.

If a driver (e.g., the pressure roller 22) drives and rotates a belt (e.g., the fixing belt 21), tension of the belt is calculated according to an Euler's formula (1) below. Tension of a stretched part of the belt and tension of a slackened part of the belt are defined by the Euler's formula (1) below.

$$T2 = T1 \cdot e^{\mu\theta} \quad (1)$$

In the Euler's formula (1), T2 represents tension of the stretched part of the belt. T1 represents tension of the slackened part of the belt. μ represents the coefficient of friction. θ represents the contact angle of the belt, that is, an angle at which the belt is wound around the thermal conduction aid 27.

The Euler's formula (1) indicates that as the coefficient of friction μ or the contact angle θ increases, the tension T2 of the stretched part of the belt increases.

If a lubricant such as fluorine grease is applied between a slide member (e.g., the nip formation unit 200) and the belt, since the viscosity of the lubricant is low at a low temperature, the coefficient of friction μ between the slide member and the belt increases. Hence, according to the Euler's formula (1), if the driver drives and rotates the belt at the low temperature, the tension T2 of the stretched part of the belt at the low temperature increases relative to that at a high temperature. No component other than the nip formation unit 200 supports an outer circumference of the fixing belt 21 at the entry to the fixing nip N. Accordingly, if the tension T2 of the stretched part of the fixing belt 21 increases, the rotation trajectory of the fixing belt 21 moves inward toward the guide face 46.

Based on the examination described above, the fixing device 20 according to this embodiment performs a lubricant movement mode in which the pressure roller 22 drives and rotates the fixing belt 21 in the rotation direction D21 at a temperature of the outer circumferential surface of the fixing belt 21, which is lower than the fixing temperature, so as to bring the accumulated lubricant 51 adhered to the guide face 46 into contact with the fixing belt 21. While the lubricant movement mode is performed, the fixing belt 21 rotates idly and therefore does not convey a sheet P. Hence, development of a toner image and conveyance of the sheet P in other components of the image forming apparatus 1, such as the image forming devices 4Y, 4C, 4M, and 4K, the transfer device 3, and the output roller pair 13 depicted in FIG. 1, may be interrupted.

For example, as described above, when the fixing belt 21 rotates at the temperature T of about 20 degrees centigrade, that is, an ambient temperature, and at the conveyance speed of 392 mm/s, the fixing belt 21 passes through a trajectory inward by about 0.5 mm compared to a regular trajectory of the fixing belt 21 that rotates to fix the toner image on the sheet P. Accordingly, the accumulated lubricant 51 accumulated on the guide face 46 adheres to the fixing belt 21 again and moves to the fixing nip N.

In the lubricant movement mode, as the rotation trajectory of the fixing belt 21 moves inward, the inner circumferential surface 21*a* of the fixing belt 21 may slide over the guide face 46 and the upstream abutment 45*a*. To address this circumstance, the lubricant movement mode is performed as needed, attaining reliability. In the lubricant movement mode, a gap of 0.5 mm or smaller is provided between the inner circumferential surface 21*a* of the fixing belt 21 and each of the guide face 46 and the upstream abutment 45*a*.

As described above, according to this embodiment, the fixing belt 21 contacts the accumulated lubricant 51 accumulated on the guide face 46, although the fixing belt 21 does not contact the accumulated lubricant 51 during regular rotation of the fixing belt 21 to fix the toner image on the sheet P at the entry to the fixing nip N, thus recirculating the lubricant. Hence, the amount of the lubricant adhered to the inner circumferential surface 21*a* of the fixing belt 21 is retained. Additionally, the lubricant not degraded by abrasion powder and the like is circulated and used, preventing degradation of the lubricant and thereby improving quality of the lubricant.

According to this embodiment, since the pressure roller 22 does not decrease pressure exerted to the fixing belt 21, the frictional driving force defined by multiplying the coefficient of friction by pressure and transmitted from the pressure roller 22 to the fixing belt 21 is identical with that during regular rotation of the fixing belt 21, preventing slippage of the fixing belt 21.

A description is provided of an advantageous configuration of the fixing device 20.

As described above, the amount of the accumulated lubricant 51 accumulated at the entry to the fixing nip N increases as the number of rotations of the fixing belt 21, that is equivalent to the number of prints, increases. Hence, the lubricant movement mode is performed based on the accumulated number of prints, that is, the accumulated number of sheets P onto which the toner image is formed. For example, when the accumulated number of prints reaches 50,000 prints, the controller 42 may perform the lubricant movement mode to adhere the accumulated lubricant 51 accumulated at the entry to the fixing nip N to the fixing belt 21 again. Alternatively, the controller 42 may perform the lubricant movement mode based on the accumulated number of rotations of the pressure roller 22.

A description is provided of advantages of the fixing device 20.

As illustrated in FIGS. 2, 3, and 4, the fixing device 20 includes a belt (e.g., the fixing belt 21), a pressure rotator (e.g., the pressure roller 22), a nip formation unit (e.g., the nip formation unit 200), and a controller (e.g., the controller 42).

The belt is endless, flexible, formed into a loop, and rotatable in a rotation direction (e.g., the rotation direction D21) to convey a recording medium (e.g., a sheet P) to fix a toner image on the recording medium. The belt includes an inner circumferential surface (e.g., the inner circumferential surface 21*a*) applied with a lubricant. The pressure rotator is disposed outside the loop formed by the belt and disposed opposite an outer circumferential surface of the belt. The pressure rotator is rotatable in a rotation direction (e.g., the rotation direction D22). The nip formation unit is disposed inside the loop formed by the belt and disposed opposite the inner circumferential surface of the belt. The nip formation unit forms a fixing nip (e.g., the fixing nip N) between the belt and the pressure rotator.

As illustrated in FIG. 5, the nip formation unit includes a guide face (e.g., the guide face 46) disposed upstream from the fixing nip in the rotation direction of the belt and contoured to separate from the pressure rotator in a direction opposite the rotation direction of the belt. The guide face is adhered with the lubricant moved from the inner circumferential surface of the belt. The controller performs a lubricant movement mode in which the pressure rotator rotates the belt in the rotation direction when the outer circumferential surface of the belt has a temperature lower than a fixing temperature at which the belt fixes the toner image on the recording medium. The belt rotating in the rotation direction brings the lubricant (e.g., the accumulated lubricant 51) adhered to the guide face into contact with the belt.

The pressure rotator rotates the belt in the rotation direction in which the belt rotates to fix the toner image on the recording medium at the temperature of the outer circumferential surface of the belt, which is lower than the fixing temperature at which the belt fixes the toner image on the recording medium properly. Accordingly, the belt rotates on a trajectory that is moved toward the guide face. Consequently, the belt comes into contact with the lubricant accumulated on the guide face to recirculate the lubricant.

According to the embodiments described above, the fixing belt 21 serves as a belt. Alternatively, a fixing film or the like may be used as a belt. Further, the pressure roller 22 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a belt that is endless and flexible, the belt being rotatable in a rotation direction to convey a recording medium to fix a toner image on the recording medium, the belt including an inner circumferential surface applied with a lubricant;

a pressure rotator being rotatable and disposed opposite an outer circumferential surface of the belt;

a heater to heat the belt;

a nip formation unit disposed opposite the inner circumferential surface of the belt, the nip formation unit to form a fixing nip between the belt and the pressure rotator, the nip formation unit including a guide face disposed upstream from the fixing nip in the rotation direction of the belt and contoured to separate from the pressure rotator in a direction opposite the rotation direction of the belt, the guide face adhered with the lubricant moved from the inner circumferential surface of the belt; and a controller to perform a lubricant movement mode in which the belt rotates in the rotation direction when the outer circumferential surface of the belt has a temperature lower than a fixing temperature at which the belt fixes the toner image on the recording medium to cause the belt rotating in the rotation direction to bring the lubricant adhered to the guide face into contact with the belt.

2. The fixing device according to claim 1, wherein the pressure rotator rotates the belt.

3. The fixing device according to claim 1, wherein the belt rotates at a speed higher than a conveyance speed at which the belt conveys the recording medium to fix the toner image on the recording medium in the lubricant movement mode.

4. The fixing device according to claim 1, wherein a gap of 0.5 mm or smaller is provided between the inner circumferential surface of the belt and the guide face in the lubricant movement mode.

5. The fixing device according to claim 1, wherein the nip formation unit further includes an upstream abutment disposed upstream from the fixing nip in the rotation direction of the belt, the upstream abutment contacting the belt and defining a curvature of the belt, which prevents breakage of the belt.

6. The fixing device according to claim 5, wherein the nip formation unit further includes a downstream face disposed downstream from the fixing nip in the rotation direction of the belt.

7. The fixing device according to claim 6, wherein the downstream face tilts toward the pressure rotator.

8. The fixing device according to claim 6, wherein the downstream face projects toward the pressure rotator.

9. The fixing device according to claim 6, wherein the nip formation unit further includes a nip portion to form the fixing nip, the nip portion being contiguous to the guide face through the upstream abutment seamlessly.

10. The fixing device according to claim 9, wherein the downstream face includes a downstream abutment contacting the belt and projecting toward the pressure rotator beyond the guide face, the upstream abutment, and the nip portion.

11. The fixing device according to claim 1, wherein the nip formation unit further includes:

a nip formation pad to form the fixing nip between the belt and the pressure rotator, the nip formation pad including an opposed face disposed opposite the inner circumferential surface of the belt; and a thermal conduction aid, covering the opposed face of the nip formation pad, to conduct heat in an axial direction of the belt.

12. The fixing device according to claim 1, wherein the controller performs the lubricant movement mode based on an accumulated number of recording media onto which the toner image is formed.

13. The fixing device according to claim 1, wherein the controller performs the lubricant movement mode based on an accumulated number of rotations of the pressure rotator.

14. The fixing device according to claim 1, wherein the guide face has a length in a range of from 5 mm to 7 mm in the rotation direction of the belt.

15. An image forming apparatus comprising:

an image forming device to form a toner image;

a belt that is endless and flexible, the belt being rotatable in a rotation direction to convey a recording medium to fix the toner image on the recording medium, the belt including an inner circumferential surface applied with a lubricant;

a pressure rotator being rotatable and disposed opposite an outer circumferential surface of the belt;

a heater to heat the belt;

a nip formation unit disposed opposite the inner circumferential surface of the belt, the nip formation unit to form a fixing nip between the belt and the pressure rotator, the nip formation unit including a guide face disposed upstream from the fixing nip in the rotation direction of the belt and contoured to separate from the pressure rotator in a direction opposite the rotation direction of the belt, the guide face adhered with the lubricant moved from the inner circumferential surface of the belt; and a controller to perform a lubricant movement mode in which the belt rotates in the rotation direction when the outer circumferential surface of the belt has a temperature lower than a fixing temperature at which the belt fixes the toner image on the recording medium to cause the belt rotating in the rotation direction to bring the lubricant adhered to the guide face into contact with the belt.

* * * * *